US009347699B2

(12) United States Patent
Huang et al.

(10) Patent No.: US 9,347,699 B2
(45) Date of Patent: May 24, 2016

(54) AIR DISCHARGE STRUCTURE FOR PACKAGED AIR CONDITIONER

(75) Inventors: Zhibin Huang, Guangdong (CN); Yuanjing Chi, Guangdong (CN); Wen Pan, Guangdong (CN)

(73) Assignee: GUANGDONG CHIGO AIR-CONDITIONING CO., LTD., Foshan (CN)

( * ) Notice: Subject to any disclaimer, the term of this patent is extended or adjusted under 35 U.S.C. 154(b) by 636 days.

(21) Appl. No.: 13/805,061

(22) PCT Filed: Mar. 10, 2011

(86) PCT No.: PCT/CN2011/071669
§ 371 (c)(1),
(2), (4) Date: Dec. 18, 2012

(87) PCT Pub. No.: WO2011/157070
PCT Pub. Date: Dec. 22, 2011

(65) Prior Publication Data

US 2013/0086935 A1 Apr. 11, 2013

(30) Foreign Application Priority Data

Jun. 18, 2010 (CN) ..... 2010 1 0205195
Mar. 10, 2011 (WO) ..... PCT/CN2011/071669

(51) Int. Cl.
*F24F 7/00* (2006.01)
*F24F 13/10* (2006.01)
(Continued)

(52) U.S. Cl.
CPC ..... *F25D 17/08* (2013.01); *F24F 1/0011* (2013.01); *F24F 13/20* (2013.01); *F24F 2001/004* (2013.01); *F24F 2221/26* (2013.01)

(58) Field of Classification Search
CPC .... F24F 1/0011; F24F 1/0014; F24F 2221/26
See application file for complete search history.

(56) References Cited

U.S. PATENT DOCUMENTS 2,267,140 A * 12/1941 Schottenberg ..... 49/82.1
4,156,825 A * 5/1979 Kondo et al. ..... 310/339
(Continued)

FOREIGN PATENT DOCUMENTS

CN 1502889 A 6/2004
CN 1544853 A 11/2004
(Continued)

OTHER PUBLICATIONS

European Search Report regarding a counterpart application 11795036.0.
(Continued)

*Primary Examiner* — Steven B McAllister
*Assistant Examiner* — Jonathan Cotov
(74) *Attorney, Agent, or Firm* — Kilpatrick Townsend & Stockton LLP

(57) ABSTRACT

An air discharge structure for a packaged air conditioner includes a front air outlet (7) disposed on the mid-upper part of a body (1), and an upper panel (9) mounted on the front air outlet (7) and slidable up and down along the body (1). An upper decorative panel (10), height of which is matched with the stroke of the upper panel (9), is mounted above the front air outlet (7) and slidable back and forth along the body (1). An upper and lower limit mechanism for the upper decorative panel is disposed between the upper decorative panel (10) and the body (1). The application can facilitate increasing the range of air supply in the air conditioner and maintain stable air supply.

17 Claims, 4 Drawing Sheets

(51) Int. Cl.

| | |
|---|---|
| ***F25D 17/08*** | (2006.01) |
| ***F24F 1/00*** | (2011.01) |
| ***F24F 13/20*** | (2006.01) |

(56) References Cited

U.S. PATENT DOCUMENTS

| | | | | |
|---|---|---|---|---|
| 4,273,283 | A * | 6/1981 | Edwards | 236/49.5 |
| 4,819,868 | A * | 4/1989 | Fornasari | 236/49.5 |
| 5,769,710 | A * | 6/1998 | Kim | F24F 13/12 454/321 |
| 5,868,617 | A * | 2/1999 | Kim | 454/324 |
| 6,089,972 | A * | 7/2000 | Gunji et al. | 454/233 |
| 6,415,622 | B2 * | 7/2002 | Kim | F24F 1/0011 62/408 |
| 6,447,391 | B1 * | 9/2002 | Kim | F24F 1/0011 454/313 |
| 6,732,380 | B1 * | 5/2004 | Lee | 2/424 |
| 7,185,504 | B2 * | 3/2007 | Kasai | F24F 1/0007 454/292 |
| 7,275,389 | B2 * | 10/2007 | Bae | 62/419 |
| 7,703,294 | B2 * | 4/2010 | Nakamura | F24F 1/0007 62/262 |
| 7,758,409 | B2 * | 7/2010 | Yamashita | F24F 1/0007 454/233 |
| 2005/0069369 | A1 * | 3/2005 | Nakashima et al. | 400/635 |
| 2005/0279118 | A1 * | 12/2005 | Son | 62/408 |
| 2007/0060040 | A1 * | 3/2007 | Ogura et al. | 454/319 |
| 2011/0185465 | A1 * | 8/2011 | Prinkey | 2/15 |

FOREIGN PATENT DOCUMENTS

| | | | |
|---|---|---|---|
| CN | 2837714 | Y | 11/2006 |
| CN | 201081371 | Y | 7/2008 |
| CN | 101315218 | A | 12/2008 |
| CN | 101858641 | A | 10/2010 |
| CN | 201697293 | U | 1/2011 |
| JP | 2006064360 | A | 3/2006 |
| JP | 2006145105 | * | 6/2006 |
| JP | 2006145105 | A | 6/2006 |
| JP | 2006145106 | A | 6/2006 |
| WO | 2011/157070 | A1 | 12/2011 |

OTHER PUBLICATIONS

International Search Report and Written Opinion of PCT/CN2011/071669 mailed May 26, 2011, 9 pages.

* cited by examiner

AIR DISCHARGE STRUCTURE FOR PACKAGED AIR CONDITIONER

This application is the national phase of International Application No. PCT/CN2011/071669 titled "AIR DISCHARGE STRUCTURE FOR PACKAGED AIR CONDITIONER", filed on Mar. 10, 2011 which claims the benefit of priority to Chinese patent application No. 201010205195.5 titled "AIR DISCHARGE STRUCTURE FOR PACKAGED AIR CONDITIONER", filed with the Chinese State Intellectual Property Office on Jun. 18, 2010. The entire disclosures thereof are incorporated herein by reference.

FIELD OF THE INVENTION

The present application relates to a technical field of air conditioner, and in particular, to an air discharge structure for an indoor unit of a floor standing split type air conditioner.

BACKGROUND OF THE INVENTION

Air discharge manner of one of the prior packaged air conditioner is as fellows: the slide panel is slid upwards to open the air outlet, thereby achieving the air discharging performance, for example, a structure described in Chinese patent application No. 200810126598.3 titled "opening and closing device for an air discharge plate of a split type floor standing air conditioner". Referring to FIGS. 1 and 2, in the air discharge structure of the packaged air conditioner, the upper panel 2 is driven, by the gear 3 and the rack 4, to move upward along the lower panel 5 such that the front air outlet 7 is opened, and the fan 6 is rotated such that the generated air flow is blew out through the front air outlet 7, thereby achieving the air supplying from the mid-upper position of the air conditioner.

This kind of structure has a drawback which mainly affects the air supplying performance of the air conditioner. As shown in FIG. 2, affected by the structure, the segment AB of the upper panel 2 is protruded from the air conditioner body 1 where the air conditioner is in operation, thereby air can only be discharged from the mid-upper position, which limits the air discharging range of the air conditioner. To supply air from the upper portion of the air conditioner, it needs to additionally provide a top air discharge component 81, however, the protruded segment AB will block the top air outlet 8, resulting in an uneven air discharging. If so, not only the protruded segment AB affects the actual usage of the air conditioner, but also the structure of the air conditioner body becomes unstable. Besides, the overall appearance of the air conditioner is damaged because of the upper panel 2, after being opened, being protruded from the air conditioner body 1.

SUMMARY OF THE INVENTION

In view of this, it is provided according to an object of the present application an air discharge structure for a packaged air conditioner, to facilitate increasing the air discharging range of the air conditioner.

To solve the above technical problem, it is provided according to the present application an air discharge structure for a packaged air conditioner. An air conditioner body of the air conditioner is provided, at a mid-upper position thereof, with a front air outlet. An upper panel, which is slidable up and down along the air conditioner body, is mounted on the front air outlet. An upper decorative plate, which is slidable forward and backward along the air conditioner body, is mounted above the front air outlet, and a height of the upper decorative plate is matched with a travel of the upper panel. And an upper and lower position-limiting mechanism for the upper decorative plate is provided between the upper decorative plate and the air conditioner body.

Preferably, a cantilever is transversely protruded from the upper panel, and a cantilever shaft is provided on the cantilever; and an oblique arm is protruded from the upper decorative plate, and the oblique arm is provided with an oblique arm groove in which the cantilever shaft can be inserted.

Preferably, an oblique arm is protruded from the upper panel, and the oblique arm is provided with an oblique arm groove; and a cantilever is transversely protruded from the upper decorative plate, and a cantilever shaft, which can be inserted in the oblique arm groove, is provided on the cantilever.

Preferably, the upper and lower position-limiting mechanism for the upper decorative plate includes: a position-limiting groove provided on a transverse arm which is protruded from the upper decorative plate, and a position-limiting block provided on the air conditioner body.

Preferably, the upper and lower position-limiting mechanism for the upper decorative plate includes: a position-limiting groove provided on the air conditioner body, and a position-limiting block provided on a transverse arm which is protruded from the upper decorative plate.

Preferably, the upper and lower position-limiting mechanism for the upper decorative plate includes: a slide rail provided on the air conditioner body, and a slide groove provided on a transverse arm which is protruded from the upper decorative plate.

Preferably, the air conditioner body is provided, at a top portion thereof, with a top air outlet, and a top air discharge component for opening and closing the top air outlet is mounted on the top air outlet.

Preferably, the top air discharge component is connected to the upper decorative plate.

Preferably, the top air discharge component is hinged to the upper decorative plate, and the top air discharge component is hinged to the air conditioner body.

Preferably, a chain and sprocket mechanism is provided between the upper panel and the air conditioner body.

Compared with the prior art, in the present application, the original upper panel is divided into two parts, that is, a new upper panel and an upper decorative plate, which makes the appearance of the air conditioner more aesthetic. What's more, the new upper panel can be moved at a large travel without affecting the overall appearance, which facilitates increasing the area of the front air outlet. Further, air can be supplied from the mid-upper position in the front side and the top portion at the same time in a case that a top air outlet is provided. Thereby the air conditioner can supply air more evenly and effectively. In addition, no additional motor and gear structure are required for the structure of the top air discharge component, which can help to save the cost.

Figure 1:
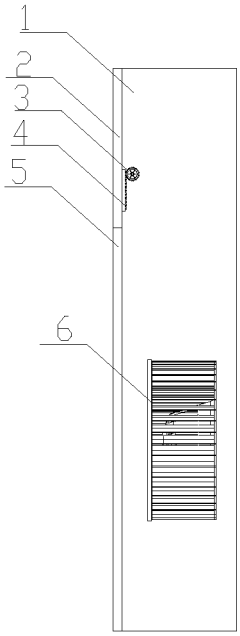
Fig. 1 Prior art
FIG. 1 is a schematic view showing an air discharge structure for a prior packaged air conditioner in a closed state.
Figure 2:
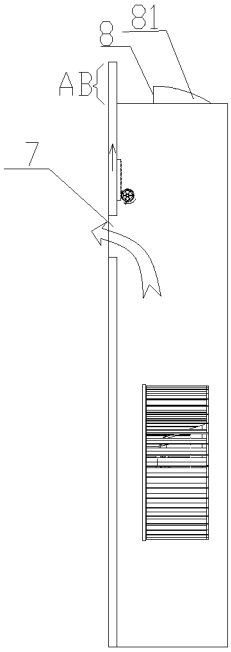
Fig.2 Prior art
FIG. 2 is a schematic view showing an air discharge structure for a prior packaged air conditioner in an open state.

REFERENCE NUMERALS IN THE FIGURES 1. air conditioner body,
2. upper panel;
3. gear;
4. rack;
5. lower panel;
6. fan;
7. front air outlet;
8. top air outlet,
9. upper panel,
10. upper decorative plate,
11. position-limiting block,
12. slide rail;
81. top air discharge component;
91. cantilever,
92. cantilever shaft,
93. oblique arm groove,
94. oblique arm;
101. oblique arm,
102. oblique arm groove,
103. cantilever shaft,
104. position-limiting groove,
105. transverse arm,
106. slide groove,
107. cantilever.

DETAILED DESCRIPTION

Hereinafter, the present application will be described in conjunction with the accompanied drawings and the embodiments.

FIGS. 3 to 6 show an air discharge structure for a packaged air conditioner according to a preferred embodiment of the present application. In the air discharge structure for the packaged air conditioner, the air conditioner body 1 is provided, at a mid-upper position thereof, with a front air outlet 7, and an upper panel 9 is mounted on the front air outlet 7. The upper panel 9 is slidable up and down along the air conditioner body 1 through a gear-rack mechanism provided between the upper panel and the air conditioner body 1. An upper decorative plate 10 slidable forward and backward along the air conditioner body 1 is mounted above the front air outlet 7, and the height of the upper decorative plate is matched with the travel of the upper panel 9, generally, they are substantially equal. Further, an upper and lower position-limiting mechanism for the upper decorative plate is provided between the upper decorative plate 10 and the air conditioner body 1, to prevent the upper decorative plate 10 from jumping up and down during the horizontal sliding thereof.

Hereinafter, various parts will be described, as shown in FIGS. 3 to 6.

A cantilever 91 is transversely protruded from the upper panel 9, and an upper panel cantilever shaft 92 is provided on the cantilever. An oblique arm 101 is protruded from the upper decorative plate 10, an oblique arm groove 102 is provided in the oblique arm, and the upper panel cantilever shaft 92 can be inserted in the oblique arm groove.

The upper and lower position-limiting mechanism for the upper decorative plate includes: a position-limiting groove 104 provided on a transverse arm 105 protruded from the upper decorative plate 10, and a position-limiting block 11 provided on the air conditioner body 1. A reverse manner may be employed, that is, the position-limiting groove is provided on the air conditioner body 1 and the position-limiting block is provided on the transverse arm 105 protruded from the upper decorative plate 10, which will not be described herein.

In addition, the air conditioner body 1 is provided, at a top portion thereof, with a top air outlet 8, and a top air discharge component 81 for opening and closing the top air outlet 8 is mounted on the top air outlet 8. The top air discharge component 81 may be connected to the upper decorative plate 10 such that the top air discharge component 81 is driven to move where the upper decorative plate 10 is moved forward and backward. Alternatively, the top air discharge component 81 may be connected to the upper panel 9. Or, the top air discharge component 81 may be provided independently, as soon as it is easy to be opened and closed. Apparently, additional motor and gear structure are not required for the structure of the top air discharge component 81 since it can be moved together with the upper panel 9 and/or the upper decorative plate 10.

Figure 7:
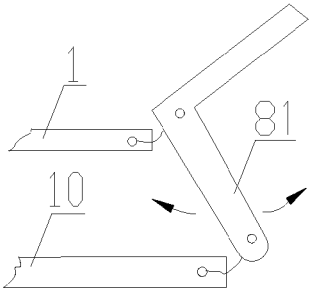
FIG. 7 is a schematic view showing a connection relationship between a top air discharge component and an upper panel shown in FIG. 3.

FIG. 7 shows the action state of the top air discharge component. The top air discharge component 81 is hinged to the upper decorative plate 10, and the top air discharge component 81 is hinged to the air conditioner body 1. Where the upper panel 9 is moved up and down, the upper decorative plate 10 is driven to move forward and backward, thereby driving the top air discharge component 81 to move, such that the top air outlet 8 is opened or closed.

Figure 3:
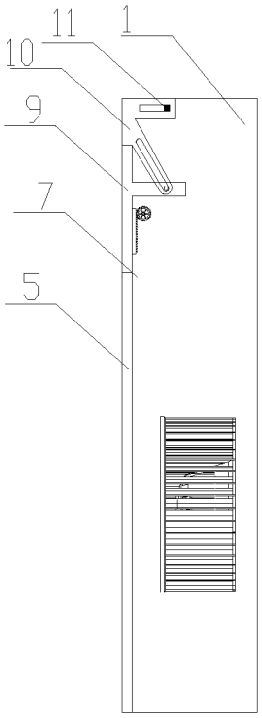
FIG. 3 is a schematic view showing an air discharge structure for a packaged air conditioner according to a first embodiment of the present application in a closed state.
Figure 4:
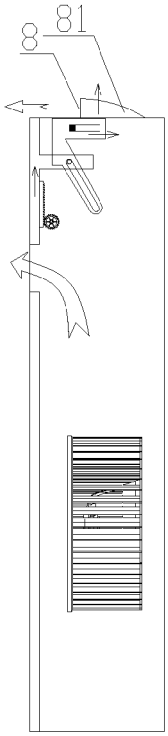
FIG. 4 is a schematic view of the air discharge structure for the packaged air conditioner in FIG. 3 in an open state.
Figure 5:
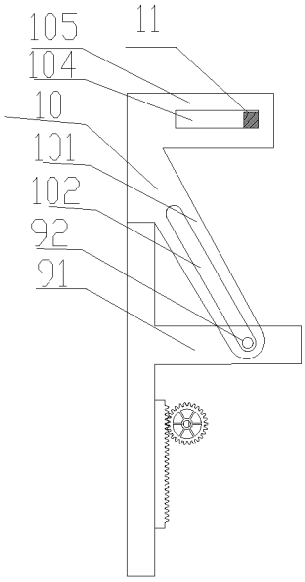
FIG. 5 is an enlarged view of a movable component of the air discharge structure for the packaged air conditioner in FIG. 3 in the closed state.
Figure 6:
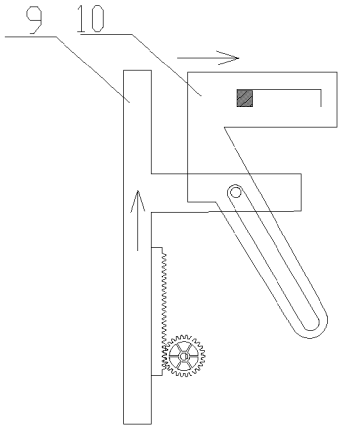
FIG. 6 is an enlarged view of the movable component of the air discharge structure for the packaged air conditioner in FIG. 3 in the open state.

Hereinafter, the operation process of the air discharge structure for the packaged air conditioner according to the present application will be described briefly.

Where the air conditioner is halted: as shown in FIG. 5, the upper panel 9 is moved downward, the front air outlet 7 is closed, and the top air discharge component 81 and the top air outlet 8 are in a hid state as shown in FIG. 3.

Where the air conditioner is in operation: as shown in FIG. 6, the upper panel 9 is driven by the gear 3 and the rack 4 to move upward. The upper decorative plate 10 is translated backward under the cooperation actions between the oblique arm groove 102 of the upper decorative plate and the cantilever shaft 92 of the upper panel as well as between the position-limiting groove 104 of the upper decorative plate and the position-limiting block 11 of the air conditioner body, to make room for the upper panel 9 such that the upper panel is moved upward continually to the state shown in FIG. 4. Meanwhile, the upper decorative plate 10 drives the top air discharge component 81 to move upward such that the top air outlet 8 is exposed. Since the front air outlet 7 is opened earlier, air can be discharged from the top portion and the mid-upper position in the front side of the air conditioner at the same time.

Where the air conditioner finishes the operation thereof: the gear 3 and the rack 4 are rotated reversely to thereby drive the upper panel 9 to move downward and drive the upper decorative plate 10 to return to its original position, and the top air discharge component 81 is moved downward and back to the state shown in FIG. 3.

It is to be noted that, other alternative technical solutions may be employed by the present application. Several examples are described hereinafter.

Figure 8:
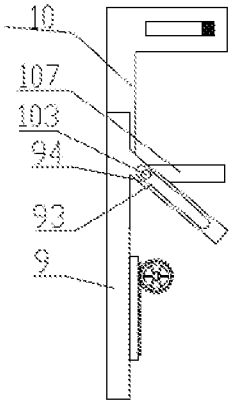
FIG. 8 is a schematic view showing an upper panel and an upper decorative plate of an air discharge structure for a packaged air conditioner according to a second embodiment of the present application.

Referring to FIG. 8, an oblique arm 94, on which an oblique arm groove 93 is provided, is protruded from the upper panel 9. A cantilever 107 is transversely protruded from the upper decorative plate 10, and a cantilever shaft 103, which can be inserted in the oblique arm groove 93, is provided on the cantilever 107. The operation principle and operation process thereof are as the above embodiment, and description thereof are omitted herein.

Figure 9:
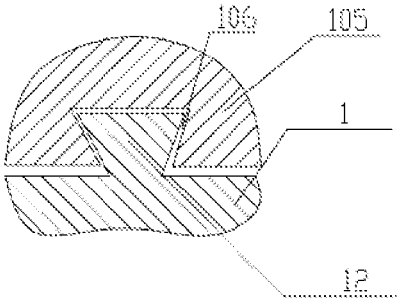
FIG. 9 is a schematic view showing an upper and lower position-limiting mechanism for an upper decorative plate of an air discharge structure for a packaged air conditioner according to a third embodiment of the present application.

Referring to FIG. 9, the upper and lower position-limiting mechanism for the upper decorative plate may be employed in another manner, that is, the air conditioner body 1 is provided with a slide rail 12, and the transverse arm 105 of the upper decorative plate 10 is provided with a slide groove 106 such that the upper decorative plate 10 is slidable along the slide rail 12 forward and backward. An opposite solution may also be employed, that is, the air conditioner body 1 is provided with a slide groove, and the transverse arm 105 of the upper decorative plate 10 is provided with a slide rail. Alternatively, a pulley and slide rail cooperation manner is employed between the transverse arm 105 of the upper decorative plate 10 and the air conditioner body such that the upper decorative plate 10 is slidable forward and backward.

The above embodiments are only preferable embodiments of the present application. It should be noted that, the preferable embodiments described above should not be construed as limitations to the present application, and the protection scope of the present application should be determined by the scopes defined by the claims. those skilled in the art can also make improvements and modifications without departing from the principle of the present application, and these improvements and modifications should also be deemed to fall into the protection scope of the present application.

What is claimed is:

1. An air discharge structure for a packaged air conditioner, wherein an air conditioner body (1) of which is provided, at a mid-upper position thereof, with a front air outlet (7), the front air outlet (7) being mounted with an upper panel (9) which is slidable up and down along the air conditioner body (1), wherein an upper decorative plate (10), which is slidable forward and backward along the top of the air conditioner body (1), is mounted above the front air outlet (7), and a height of the upper decorative plate is matched with a travel of the upper panel (9); and an upper and lower position-limiting mechanism for the upper decorative plate is provided between the upper decorative plate (10) and the air conditioner body (1) wherein a cantilever (91) is transversely protruded from the upper panel (9), and a cantilever shaft (92) is provided on the cantilever (91); and an oblique arm (101) is protruded from the upper decorative plate (10), and the oblique arm (101) is provided with an oblique arm groove (102) in which the cantilever shaft (92) can be inserted to provide linked movement, wherein a cantilever (91) is transversely protruded from the upper panel (9), and a cantilever shaft (92) is provided on the cantilever (91); and an oblique arm (101) is protruded from the upper decorative plate (10), and the oblique arm (101) is provided with an oblique arm groove (102) in which the cantilever shaft (92) can be inserted or wherein an oblique arm (94) is protruded from the upper panel (9), and the oblique arm (94) is provided with an oblique arm groove (93); and a cantilever (107) is transversely protruded from the upper decorative plate (10), and a cantilever shaft (103), which can be inserted in the oblique arm groove (93), is provided on the cantilever (107).

2. The air discharge structure for the packaged air conditioner according to claim 1, wherein the upper and lower position-limiting mechanism for the upper decorative plate comprises: a position-limiting groove (104) provided on a transverse arm (105) which is protruded from the upper decorative plate (10), and a position-limiting block (11) provided on the air conditioner body (1).

3. The air discharge structure for the packaged air conditioner according to claim 2, wherein a gear-rack mechanism is provided between the upper panel and the air conditioner body (1).

4. The air discharge structure for the packaged air conditioner according to claim 1, wherein the upper and lower position-limiting mechanism for the upper decorative plate comprises: a position-limiting groove provided on the air conditioner body (1), and a position-limiting block (11) provided on a transverse arm (105) which is protruded from the upper decorative plate (10).

5. The air discharge structure for the packaged air conditioner according to claim 4, wherein a gear-rack mechanism is provided between the upper panel and the air conditioner body (1).

6. The air discharge structure for the packaged air conditioner according to claim 1, wherein the upper and lower position-limiting mechanism for the upper decorative plate comprises: a slide rail (12) provided on the air conditioner body (1), and a slide groove (106) provided on a transverse arm (105) which is protruded from the upper decorative plate (10).

7. The air discharge structure for the packaged air conditioner according to claim 6, wherein a gear-rack mechanism is provided between the upper panel and the air conditioner body (1).

8. The air discharge structure for the packaged air conditioner according to claim 1, wherein the air conditioner body (1) is provided, at a top portion thereof, with a top air outlet (8), and a top air discharge component (81) for opening and closing the top air outlet (8) is mounted on the top air outlet (8).

9. The air discharge structure for the packaged air conditioner according to claim 8, wherein the top air discharge component (81) is connected to the upper decorative plate (10).

10. The air discharge structure for the packaged air conditioner according to claim 8, wherein a gear-rack mechanism is provided between the upper panel and the air conditioner body (1).

11. The air discharge structure for the packaged air conditioner according to claim 9, wherein the top air discharge component (81) is hinged to the upper decorative plate (10), and the top air discharge component (81) is hinged to the air conditioner body (1).

12. The air discharge structure for the packaged air conditioner according to claim 9, wherein a gear-rack mechanism is provided between the upper panel and the air conditioner body (1).

13. The air discharge structure for the packaged air conditioner according to claim 11, wherein a gear-rack mechanism is provided between the upper panel and the air conditioner body (1).

14. The air discharge structure for the packaged air conditioner according to claim 1, wherein a gear-rack mechanism is provided between the upper panel and the air conditioner body (1).

15. The air discharge structure for the packaged air conditioner according to claim 1, wherein a gear-rack mechanism is provided between the upper panel and the air conditioner body (1).

16. An air discharge structure for a packaged air conditioner, wherein an air conditioner body (1) of which is provided, at a mid-upper position thereof, with a front air outlet (7), the front air outlet (7) being mounted with an upper panel (9) which is slidable up and down along the air conditioner body (1), wherein an upper decorative plate (10), which is slidable forward and backward along the top of the air conditioner body (1), is mounted above the front air outlet (7), and a height of the upper decorative plate is matched with a travel of the upper panel (9); and an upper and lower position-limiting mechanism for the upper decorative plate is provided between the upper decorative plate (10) and the air conditioner body (1), wherein an oblique arm (94) is protruded from the upper panel (9), and the oblique arm (94) is provided with an oblique arm groove (93); and a cantilever (107) is transversely protruded from the upper decorative plate (10), and a cantilever shaft (103), which can be inserted in the oblique arm groove (93), is provided on the cantilever (107) to provide linked movement.

17. The air discharge structure for the packaged air conditioner according to claim 16, wherein a gear-rack mechanism is provided between the upper panel and the air conditioner body (1).

* * * * *